US009767772B2

(12) United States Patent
Cobb

(10) Patent No.: US 9,767,772 B2
(45) Date of Patent: Sep. 19, 2017

(54) GUITAR PICK

(71) Applicant: Nathan Ian Cobb, Guthrie, OK (US)

(72) Inventor: Nathan Ian Cobb, Guthrie, OK (US)

( * ) Notice: Subject to any disclaimer, the term of this patent is extended or adjusted under 35 U.S.C. 154(b) by 0 days.

(21) Appl. No.: 15/338,384

(22) Filed: Oct. 29, 2016

(65) Prior Publication Data

US 2017/0124992 A1 May 4, 2017

Related U.S. Application Data

(60) Provisional application No. 62/248,221, filed on Oct. 29, 2015.

(51) Int. Cl.
*G10D 3/16* (2006.01)

(52) U.S. Cl.
CPC ..... *G10D 3/163* (2013.01)

(58) Field of Classification Search
CPC ..... G10D 3/163; G10D 1/005
USPC ..... 84/320–322
See application file for complete search history.

(56) References Cited

U.S. PATENT DOCUMENTS

| | | | | |
|---|---|---|---|---|
| 3,595,118 | A * | 7/1971 | Paxton | G10D 3/163 84/322 |
| 4,785,708 | A | 11/1988 | Vaughan | |
| 6,140,564 | A | 10/2000 | Pia | |
| 6,245,977 | B1 | 6/2001 | Byrns | |
| 7,804,013 | B2 | 9/2010 | Rapaport | |
| 8,716,581 | B1 | 5/2014 | Boyd | |
| 8,962,959 | B1 * | 2/2015 | Mier | G10D 3/163 84/322 |
| 2005/0211053 | A1 * | 9/2005 | Ball | G10D 3/163 84/322 |
| 2006/0156895 | A1 | 7/2006 | Judd | |

* cited by examiner

*Primary Examiner* — Kimberly Lockett

(57) ABSTRACT

A guitar pick with an internal cutout feature which enables the pick to securely clip to thin articles such as guitar straps. Other embodiments are described.

4 Claims, 3 Drawing Sheets

GUITAR PICK

CROSS-REFERENCE TO RELATED APPLICATIONS

This application claims the benefit of provisional patent application Ser. No. 62/248,221, filed 2015 Oct. 29 by the present inventor.

FEDERALLY SPONSORED RESEARCH

Not applicable

PARTIES TO A JOINT RESEARCH AGREEMENT

Not Applicable

SEQUENCE LISTING OR PROGRAM

Not Applicable

BACKGROUND OF THE INVENTION

Guitarist the world over have long known the frustration of dropping a pick during a live performance. The most obvious solution to this problem is, of course, to improve the grip of the pick itself to make it much easier to hold and much more difficult to drop. Since the introduction of the first modern pick by D'Andrea USA in 1922, musicians have added cork to their picks, texturized their picks, punched holes in them, and even employed adhesive pads in an attempt to improve their grip. Many of these approaches have been extremely successful and are in wide use today but despite these advancements, and their ubiquity, guitarist are still dropping their picks. Many inventors and musicians, resigned to the fact that dropped picks are a fact of life, focused their efforts less on prevention and more on rapid recovery. From these creators sprang devices such as the now very popular pick rail. A pick rail is simply a pick holder mounted to a microphone stand that a guitarist can pull a pick from at a moment's notice and hopefully not miss a beat. These rails work exceptionally well and are used by professionals and amateurs alike. But what if a guitarist isn't conveniently near a microphone stand when he drops his pick? The obvious answer to that question has been to mount the pick holder to the guitar or to the guitarist himself. In this vein, inventors have proposed various pick holders that mount to guitar straps, pick holders that mount to head-stocks, and pick holders that mount to the guitar body itself, just to name a few. There are even pick holder bracelets and necklaces. The list goes on but the unifying feature of all of these pick holding approaches is that they all require at least one extra device, apparatus, or specialized component in addition to the picks themselves. Although an attempt has been made to create stand-alone picks that can be clipped to guitar strings without the need for extra components (U.S. Pat. No. 3,595,118A, Paxton, 1969), these picks and their variants don't lend themselves to practical use during live performances as they are somewhat cumbersome to quickly unclip from the strings when needed. Clearly there is still room for improvement. The first modern guitar pick was invented in 1922 (and was likely dropped on the floor the same day) yet, after almost 100 years of innovation, guitarists are still searching for better and more convenient ways to avoid the age old trauma of suddenly finding themselves on stage, mid-solo, without a pick.

BRIEF DESCRIPTION OF THE DRAWINGS

The invention description below refers to the accompanying drawings in which.

DETAILED DESCRIPTION OF THE INVENTION

Figure 1:
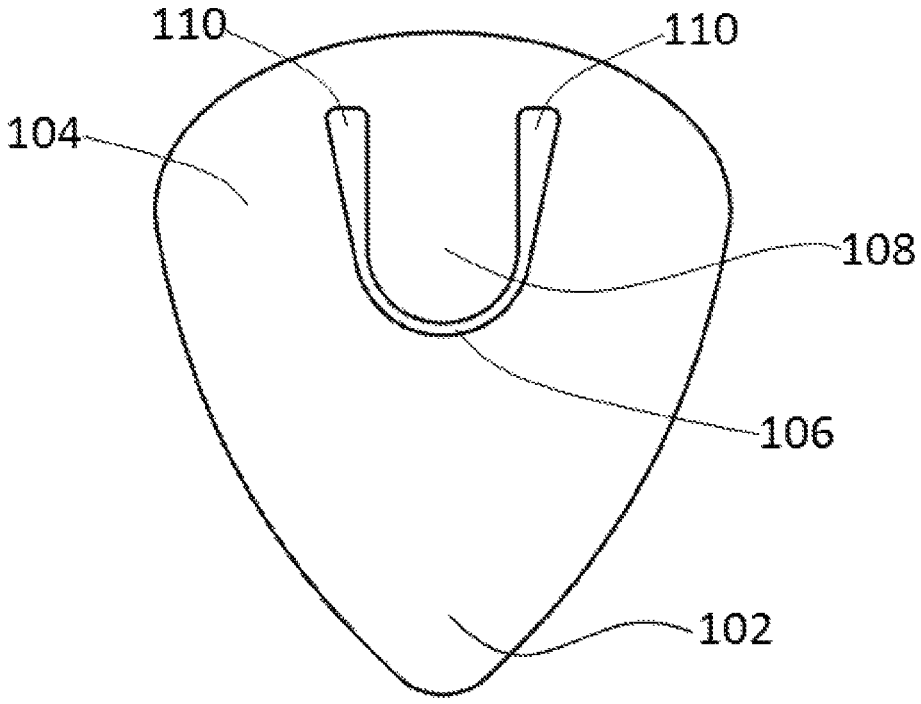
FIG. 1 illustrates various aspects of a guitar pick in accordance with one embodiment.
Figure 2:
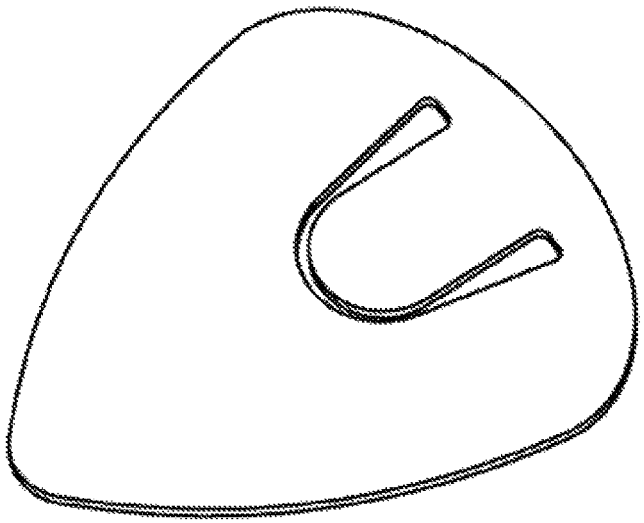
FIG. 2 illustrates a perspective view of a guitar pick in accordance with one embodiment.

FIG. 1 depicts a front view of one embodiment of the guitar pick comprising a tip portion 102, a body portion 104, and a tongue cutout 106 which defines the shape of an internal tongue feature 108. The tongue cutout 106 is sized and positioned on the body portion 104 such that the stiffness of the pick is not substantially affected. The tongue cutout 106, near the base of the tongue feature 108, incorporates relief cutouts 110 which serve to locally enlarge the profile of the tongue cutout 106 on either side of the base of the tongue feature 108. In this embodiment, the relief cutouts 110 are wedge shaped with the widest part of the wedge situated at the base of the tongue feature 108, however, relief cutouts in other embodiments can take any shape suitable to the purpose including but not limited to circular cutouts (see FIG. 4 for an example of a circular relief cutout 406). FIG. 2 depicts a perspective view of the embodiment of the guitar pick depicted in FIG. 1. The shape of this embodiment is a conventional teardrop shape but other shapes are expressly contemplated including but not limited to triangular and circular pick shapes.

Figure 3:
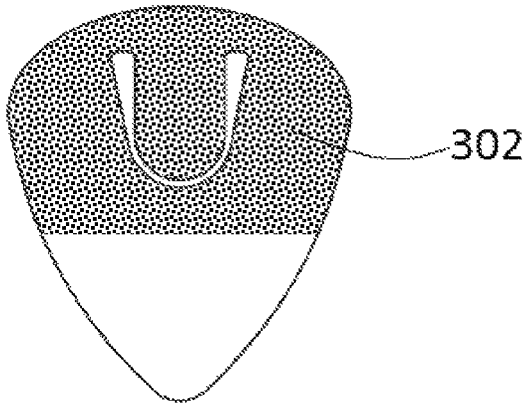
FIG. 3 illustrates a guitar pick with textured surfaces in accordance with one embodiment.
Figure 4:
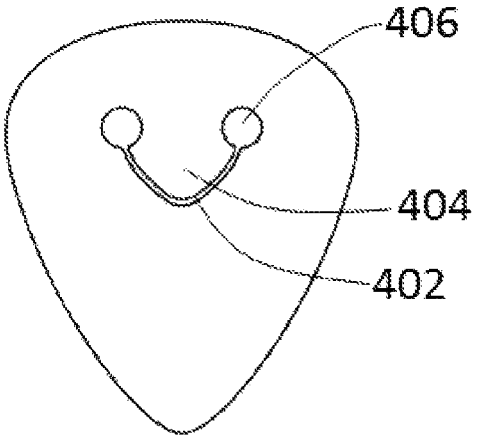
FIG. 4 illustrates a guitar pick with a barbed tongue in accordance with one embodiment
Figure 5:
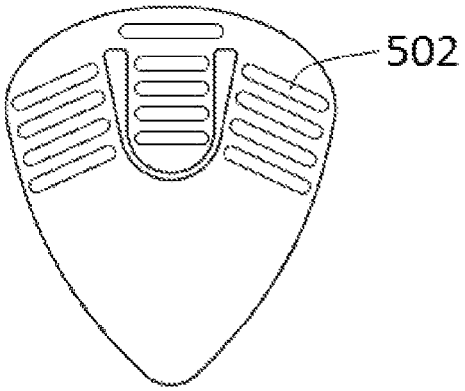
FIG. 5 illustrates a guitar pick with ridge features in accordance with one embodiment

FIGS. 3, 4, and 5 depict additional embodiments. FIG. 3 depicts one embodiment which incorporates a textured, grip-enhancing surface 302. FIG. 4 depicts one embodiment which features an alternate tongue cutout 402, a barbed tongue 404, and circular relief cutouts 406. FIG. 5 depicts one embodiment which incorporates grip-enhancing ridges 502.

The guitar pick can be made from any popular guitar pick material including but not limited to plastic, metal, or wood, using any number of manufacturing processes or techniques including but not limited to die cutting, injection molding, machining, or hand-crafting.

Operation

Figure 6:
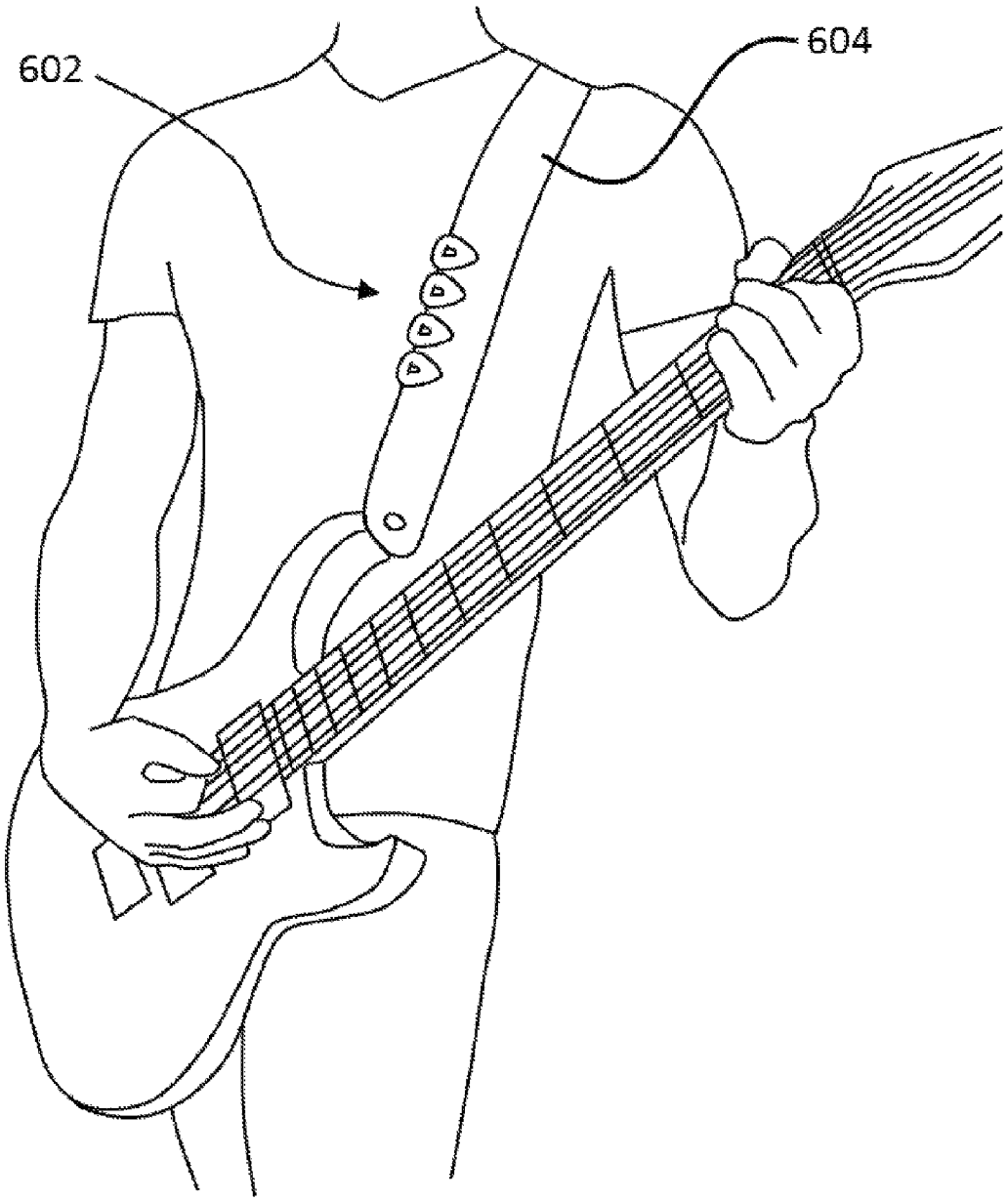
FIG. 6 illustrates a plurality of guitar picks in accordance with one embodiment clipped to a guitar strap.

The manner of using the guitar pick is identical to that for conventional picks in present use except that when the guitar pick is not being used for playing a stringed instrument it can be clipped to a guitar strap or other similarly thin article for storage or display. FIG. 6 illustrates an exemplary use case for one embodiment in which several guitar picks 602 are clipped to a guitar strap 604. This clipping capability is enabled by the tongue cutout 106, the tongue feature 108, and the relief cutouts 110 depicted in one embodiment in FIG. 1. By gently flexing the tongue feature 108 outward away from the body portion 104, the user creates a gap between the tongue feature 108 and the body portion 104 into which the edge of a guitar strap, in this example, can be inserted. The relief cutouts 110 provide a suitable clearance to allow for the full insertion of the guitar strap up to the base of the tongue feature 108 while also preventing the excessive build-up of bending stresses near the base of the tongue feature 108. The natural resilience of the pick material generates a clamping force between the tongue feature 108 and the body portion 104 while the relief cutouts 110 prevent the guitar strap from being excessively pinched at the base of the tongue feature 108 which would otherwise tend to push the guitar strap away from the apex of the clamp formed by the tongue feature 108 and body portion 104. The slip-resistance of the clamping surfaces of the pick can be modified by changing the material selection, adding surface features (FIGS. 3 and 5), and or by tailoring the shape of the tongue and relief cutout features (FIG. 4).

CONCLUSION, RAMIFICATIONS, AND SCOPE

Accordingly, the reader will see that the guitar picks of the various embodiments can be securely clipped to thin articles such as, but not limited to, guitar straps. In addition, the relevant features that enable the guitar pick to be used in this manner are such that they do not significantly diminish the overall stiffness and flexural character of the pick.

While the above description contains much specificity, these details should not be construed as limitations in the scope of any embodiment, but as exemplifications of various embodiments thereof. Accordingly, the scope should be determined by the appended claims and their legal equivalents, rather than by the examples given.

The invention claimed is:

1. A musical instrument pick, comprising:

a. a pick surface having a body portion;

b. a tongue cutout forming a single internal tongue feature in said body portion, the overall width of said tongue cutout being sufficiently narrow with respect to said body portion, whereby significantly decreased stiffness of the pick is avoided; and c. relief cutouts incorporated in said tongue cutout near the base of said tongue feature, whereby a thin structure can be inserted between the tongue feature and the body portion without causing pinching of said thin structure at the base of said tongue feature.

2. The pick of claim 1, wherein said pick surface is textured.

3. The pick of claim 1, wherein said pick surface incorporates ridges.

4. The pick of claim 1, wherein said tongue cutout is shaped to form barb features.

* * * * *